US010125526B2

(12) United States Patent
Mahoney et al.

(10) Patent No.: US 10,125,526 B2
(45) Date of Patent: Nov. 13, 2018

(54) DOOR SECURITY APPARATUS

(71) Applicant: DC PUBLIC EDUCATION FUND, Washington, DC (US)

(72) Inventors: John Mahoney, Bethesda, MD (US); Dea Damita Onyenobi, Washington, DC (US); Deonte Antrum, Washington, DC (US); James Poindexter, Washington, DC (US); Khalonji Bullock, Washington, DC (US); Chidinma Idika, Washington, DC (US); Jenifer Duong, Washington, DC (US); Mark Miranda, Washington, DC (US); Jed-Paolo DelaTorre, Washington, DC (US); Alexis Vivar, Washington, DC (US); Maya Lara, Washington, DC (US); Anjreyev Harvey, Washington, DC (US)

(73) Assignee: DC Public Education Fund, Washington, DC (US)

( * ) Notice: Subject to any disclaimer, the term of this patent is extended or adjusted under 35 U.S.C. 154(b) by 477 days.

(21) Appl. No.: 14/744,356

(22) Filed: Jun. 19, 2015

(65) Prior Publication Data

US 2016/0369541 A1 Dec. 22, 2016

(51) Int. Cl.
*E05C 19/18* (2006.01)

(52) U.S. Cl.
CPC ..... *E05C 19/18* (2013.01); *E05C 19/184* (2013.01)

(58) Field of Classification Search
CPC ..... E05B 17/2084; E05B 17/20; E05C 17/02; E05C 17/54; E05C 19/003; E05C 19/18;
(Continued)

(56) References Cited

U.S. PATENT DOCUMENTS 3,623,268 A * 11/1971 Zepf ..... E05C 19/18 292/145
4,653,785 A * 3/1987 Tobey ..... E05C 19/182 29/897.3

(Continued)

FOREIGN PATENT DOCUMENTS

JP 2002242511 A * 8/2002
JP 2005009128 A * 1/2005

OTHER PUBLICATIONS

Brookshire, B., "Students invent safer school lock", Eureka Lab!, Oct. 25, 2013, pp. 1-3, downloaded from the Internet at http://student.societyforscience.org/blog/eureka-lab/students-invent-safer-school-lock on Aug. 24, 2015.

(Continued)

*Primary Examiner* — Christine M Mills
(74) *Attorney, Agent, or Firm* — Greenberg Traurig, LLP

(57) ABSTRACT

A door security apparatus is disclosed herein. The door security apparatus comprises a sleeve member, a door engagement member and a spacer, and is configured to engage a double-lever arm door closer to allow for the locking of a door from the inside. The apparatus further comprises a locking mechanism for keeping the apparatus attached to the door closer. The door engagement member is configured to engage the top edge of a door, the sleeve member is configured to slidably engage the double-lever arm door closer, and the spacer is configured to connect the door engagement member and the sleeve member.

20 Claims, 10 Drawing Sheets

(58) Field of Classification Search

CPC .... E05C 19/182; E05C 19/184; E05C 19/188; E05D 11/06; E05D 11/1014; E05D 11/10; E05D 11/1007; E05F 3/22; E05F 3/227; E05F 3/00; Y10S 292/15; Y10S 292/65; Y10S 16/17; Y10S 292/17; Y10T 70/40; Y10T 70/402; Y10T 70/411; Y10T 70/5168; Y10T 292/694; Y10T 292/03; Y10T 292/34; Y10T 292/37; Y10T 292/42; Y10T 292/426; Y10T 292/432; Y10T 292/438; Y10T 292/65; Y10T 292/67; Y10T 292/71; Y10T 292/73; Y10T 16/61

USPC ..... 292/341.14, 1, 288, 289, 300, 301, 302, 292/303, 338, 339, 342, 343, DIG. 15, 292/DIG. 65, DIG. 17; 70/14, 15, 19, 94; 16/319, 337, 82, DIG. 17; 248/213.1, 248/351

See application file for complete search history.

(56) References Cited

U.S. PATENT DOCUMENTS 4,756,052 A * 7/1988 Diedrich ..... E05C 17/54 16/82
5,193,695 A * 3/1993 Mann ..... E05D 11/1007 108/134
5,547,236 A * 8/1996 Gregory ..... E05C 19/182 292/148
5,701,768 A * 12/1997 Khalsa ..... E05B 13/002 70/14
5,702,218 A * 12/1997 Onofrio ..... E04B 9/006 411/341
5,775,149 A * 7/1998 Small ..... E05B 13/001 109/50
5,865,484 A * 2/1999 Johns ..... E05C 19/182 292/288
6,311,367 B1 * 11/2001 Larsen ..... E05F 3/221 16/375
9,487,989 B2 * 11/2016 Nietzel ..... E05F 3/227
9,522,449 B2 * 12/2016 Nietzel ..... E05F 3/22
9,816,295 B1 * 11/2017 Taylor, III ..... E05B 65/10
2014/0015259 A1 * 1/2014 Harrigan ..... E05B 65/0014 292/156
2014/0306464 A1 * 10/2014 Lowe ..... E05C 19/003 292/260

OTHER PUBLICATIONS

Mollenbeck, A., "D.C. students create specialized lock to thwart possible shooter", WTOP, Oct. 23, 2013, pp. 1-2, downloaded from the Internet at http://wtop.com/news/2013/10/dc-students-create-specialized-lock-to-thrwart-possible-shooter/slide/1/, on Aug. 24, 2015.

DeadStoppers Banneker InvenTeam—Who We Are, 1 page, downloaded from the Internet at http://deadstop.wix.com/banneker-inventeam, on Sep. 1, 2015.

Bearacade® Door Control System—How it Works, © 2014 National School Control Systems, pp. 1-3, downloaded from the internet at http://doorbearacade.com/how-it-works/, on Sep. 1, 2015.

The Portable Affordable Lockdown System™ (PALS™), Lockdown Solutions © 2015, 5 pages, downloaded from the internet at http://www.lockdownsolutions.org/, on Sep. 1, 2015.

Nightlock Lockdown Classroom Door Barricade, Lockdown device for extreme emergencies, by Taylor Brothers Door Lock, pp. 1-10, downloaded from the internet at http://nightlock.com/classroom-lockdown/, on Sep. 1, 2015.

Lemelson-MIT InvenTeams, presented Jun. 20, 2014, EurekaFest 2014: Benjamin Banneker Academic High School InvenTeam, 2 pages, downloaded at the internet at http://techtv.mit.edu/collections/lemelson-mit:1745:3693/videos/29427-eurekafest-2014-benjamin-banneker-academic-high-school-inventeam, on Sep. 1, 2015.

* cited by examiner

DOOR SECURITY APPARATUS

BACKGROUND

The December 2012 shooting at former Sandy Hook Elementary School was one of a number of prominent shooting incidents to occur in schools across the United States over the last 20 years. Doors to classrooms are often not equipped with a locking device that may be locked from the inside. Therefore, students located inside a classroom are unable to quickly prevent the doors from opening if an armed assailant wants to enter a classroom.

SUMMARY OF THE DISCLOSURE

Broadly, the present disclosure relates to a door security apparatus for engaging a double-lever arm door closer to allow for the locking of a door from the inside. For example, the door security apparatus can be configured to temporarily and removably lock a classroom door from the inside by engaging a double-lever arm door closer (which may also be referred to herein as a "door closer") located on the inside of the classroom door.

According to one embodiment, a door security apparatus includes a door engagement member, a sleeve member and a spacer. The door engagement member includes a first side with a top end and bottom edge, a second side with a top edge and bottom edge, and a top side interconnecting the first and second sides, thereby defining a channel that is configured to receive a top of a door. The sleeve member has a hollow, tubular channel which is configured to slidably engage a double-lever arm door closer when the door closer is in a closed position, thereby restricting the double-lever arms of the door closer from moving to an open position. The spacer is connected to the door engagement member and the sleeve member.

In some embodiments, the sleeve member further comprises a locking system. The locking system includes a port disposed within the sleeve member and a retaining device which is configured to engage the port. The retaining device further comprises an elongated port engagement member that is disposed through the port, and a fastener that is attached to the elongated port member. The elongated port member is disposed between the double-lever arms of the door closer so that, as disposed, the elongated port engagement member restricts the sleeve member from disengaging from the double-lever arms. The fastener, as attached to the elongated port member, physically engages the perimeter of the port and keeps the port engagement member within the port.

In some embodiments, the port is a first port and the locking system further comprises a second port disposed within the sleeve member. The elongated port engagement member is disposed through the first port and the second port. In some embodiments the second port is located adjacent to the first port and the elongated port engagement member may be disposed through either the first port or the second port.

In some embodiments the fastener is a first fastener, and the retaining device further comprises a second fastener. The first fastener is configured to engage the perimeter of the first port, and the second fastener is configured to engage the perimeter of the second port. In some embodiments the fastener may be a female threaded member and the elongated port engagement member may be a male threaded member, wherein the female threaded fastener is threaded to the male threaded port engagement member. In some embodiments the fastener is spring loaded.

In another embodiment there is a method for locking a door comprising first placing a door security apparatus on top of a door, closing the door, sliding a sleeve member over the double-lever arms of a double-lever arm door closer, disposing an elongated port engagement member into a port of a locking system, and attaching a fastener to the elongated port engagement member.

The door security apparatus of the method further comprises a door engagement member, the sleeve member and a spacer. The door engagement member includes a first side with a top end and bottom edge, a second side with a top edge and bottom edge, and a top side interconnecting the first and second sides, thereby defining a channel that is configured to receive a top of a door. The sleeve member has a hollow, tubular channel and a locking system, wherein the locking system comprises at least one port disposed within the sleeve member and a retaining device. The retaining device further comprises the elongated port engagement member and the fastener. The spacer is connected to the door engagement member and the sleeve member.

The sliding step further comprises the sleeve member restricting the double-lever arms of the door closer from moving to an open position. The disposing step further comprises the elongated port engagement member restricting the sleeve member from disengaging the double-lever arm door closer. The attaching step further comprises the fastener preventing the elongated port engagement member from disengaging with the port.

In some embodiments, the at least one port is a first port and the locking system further comprises a second port adjacent to the first port, wherein the disposing step further comprises selecting either the first port or the second port for the disposing step, and then completing the disposing step. In some embodiments, the at least one port is a top port and the locking system further comprises a second port, wherein the second port is a bottom port, and wherein the disposing step further comprises disposing the elongated port engagement member through the top port and the bottom port.

In some embodiments, the fastener is a first fastener and the retaining device further comprises second fastener. The attaching step further comprises attaching the first fastener to the elongated port engagement member at a perimeter of the top port, and attaching the second fastener to the elongated port engagement member at a perimeter of the bottom port.

DETAILED DESCRIPTION

Figure 1:
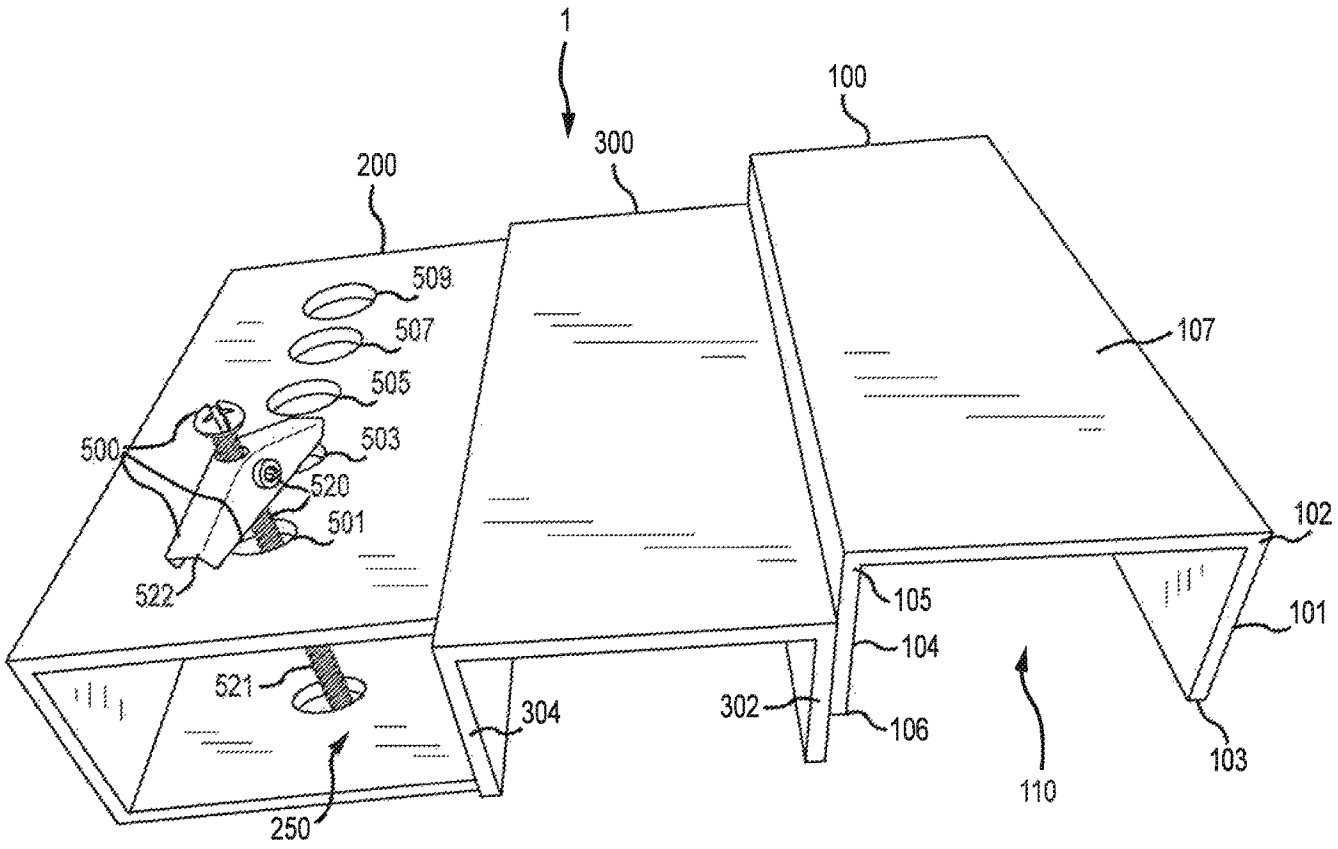
FIG. 1 is a top perspective view of one embodiment of a door security apparatus.

As used herein, a "door security apparatus" is an apparatus that includes a door engagement member, a sleeve member and a spacer. The door security apparatus may be permanently affixed to a door or it may be configured to be attached temporarily to a door. The door security apparatus may be portable and capable of use by an individual. In some embodiments, the door security apparatus may remain permanently attached to the top edge of the door. Alternatively the door security apparatus may be separately stored away from or near the door, and shall be configured to removably engage the door on an as-needed basis. The door security apparatus may comprise a metal, such as aluminum or steel. In some embodiments the door security apparatus may comprise plastic or polymers. In some embodiments the door security apparatus may comprise any material capable of preventing the double-lever arms of the door closer from moving to an open position when the door closer is engaged with the sleeve member and pressure is applied from the other side of the door. The door may be any door that people walk through, but is preferably a door where a portable and temporary security apparatus would be beneficial, whether used alone or in combination with a pre-existing locking mechanism or security device. The door may be, for example, a door to a hotel or motel, an office, an apartment, a movie theater, a bathroom, or a classroom.

As used herein, a "door engagement member" is an apparatus configured to engage a top of a door (e.g. the top edge of a door), having a first side with a top edge and a bottom edge, a second side with a top edge and a bottom edge, and a top side interconnecting the first side and second side, defining a channel whereby the channel shall engage with the top side of a door. The channel may be configured to fit any shape of the top of a door. In some embodiments, the channel may be a U-shaped channel. For example, the U-shaped channel may have a flat upper surface or a curved upper surface. The top side of the door engagement member may further be configured or customized to allow a door to close properly, and such configuration may include modifying the shape of the channel or any dimension of the door engagement member such as length, width or thickness.

As used herein, a "sleeve member" is an apparatus having a hollow, tubular channel which may be configured to slidably engage one or more double-lever arms of a double-lever arm door closer, thereby restricting the double-lever arms of the double-lever arm door closer from moving to an open position. A cross section of the hollow, tubular channel of the sleeve member may be any geometric shape. In some embodiments the cross section may be non-arcuate, such as having a rectangular or square shape. In other embodiments, the cross section may be arcuate, such as having a circular or round shape. The tubular channel is configured to slide over double-lever arms of a double-lever arm door closer and remain thereto. The tubular channel should be designed so that the fit over the double-lever arms is sufficient to prevent the entire door security apparatus from falling off the door and/or door closer. The sleeve member may further comprise a locking system (as described herein).

As used herein, a "spacer" is an apparatus configured to connect a door engagement member with a sleeve member. A spacer may be a solid, planar object of any geometric shape, which may be permanently or removably attached to either or both of the sleeve member and the door engagement member. A spacer may also be a tether or linker, such as, e.g., a chain, coil, wire or spring, which may be permanently or removably attached to either or both of the sleeve member and the door engagement member. The spacer may be attached to the door engagement member and sleeve member by one or more bolts. Alternatively, the spacer may be permanently welded or soldered to either or both of the sleeve member and door engagement member. The spacer may also be attached through a click-lock mechanism. The size and shape of the spacer may be adjustable. In some embodiments, the width or length or thickness of the spacer may be adjustable. The spacer may be removably fastened to the sleeve member and the door engagement member so that it may be removed and replaced with a spacer of different width and/or length and/or thickness. In further embodiments, the spacer may be a linker or tether. The linker or tether may be, for example, a chain, wire, spring, cord, rope or other non-planar device used to connect the door engagement member with the sleeve member.

As used herein, a "double-lever arm door closer" may be used interchangeably with "door closer," and is any apparatus configured to automatically close a door, comprising a door closer body and two or more double-lever arms that are connected by at least one joint or hinge. The two or more double-lever arms comprise a first arm and a second arm, with the first arm connected directly to the door closer body and the joint or hinge, and the second arm connected to the first arm through the joint or hinge. The joint may be a first joint and the door closer may further comprise a second joint which is located on the second arm that connects the second arm to an apparatus configured to attach the second arm to a door or a frame of a door. In some embodiments the door closer body is configured parallel to the top edge of the door. In some embodiments the door closer body is configured parallel to the side edge of the door. In some embodiments the first joint is a pivot joint, and in other embodiments it may be a hinge joint. In some embodiments, when the double-lever arms are in a closed position and ready to be engaged by a sleeve member, the first and second double-lever arms will form an acute angle (e.g., an angle of not greater than 25 degrees). In some embodiments, the double-lever anus will be parallel to the top edge of the door when the double-lever arms are in a closed position. In some embodiments the double-lever arms will be perpendicular to the plane of the door when the double-lever arms are in a closed position. In some embodiments, the double-lever arm door closer is spring loaded. In other embodiments, the double-lever arm door closer may be hydraulically or pneumatically controlled.

As used herein, "closed position" shall mean the angle defined by the double-lever arms of the door closer when the door to which the door closer is attached is closed.

As used herein, "open position" shall mean the angle defined by the double-lever arms of the door closer when the door to which the door closer is attached is open.

As used herein, a "locking system" shall mean a system that is configured to keep the sleeve member attached to the double-lever arms of the door closer and comprises at least one port disposed within the sleeve member and further comprises a retaining device. The locking system may have at least one or more ports, or at least two or more ports, or a plurality of ports. The ports may be opposite to or adjacent to one another. The locking system may have a plurality of ports located both opposite and adjacent to the other ports. In some embodiments the ports are top ports, and the ports located opposite the top ports are bottom ports. The ports may be any geometric shape, but in preferred embodiments will be configured to a shape that best engages with the retaining device.

As used herein, a "retaining device" shall mean a device that is configured to engage at least one port of the locking system, and which is further configured to lock the sleeve member onto the double-lever arms of the door closer. The retaining device is comprised of an "elongated port engagement member," which is configured to restrict the sleeve member from disengaging from the double-lever arms of the door closer, and a "fastener," which is configured to attach to the elongated port engagement member and to physically engage the perimeter of the port of the locking system thereby keeping the elongated port engagement member engaged with the port. The elongated port engagement member may engage any port of the retaining device. The elongated port engagement member may be a pin, rod, screw or any elongated device that may be disposed through at least one port of the locking system. It may be configured to be disposed through a first (top) port and a second (bottom) port. Any port may be selected for engaging the port engagement member, and the selection of a port will be determined by selecting which port best supports the locking function of the retaining device. The fastener is configured to keep the elongated port engagement member engaged with the port. There may be one or more fasteners, which may be referred to as a first (top) and second (bottom) fastener. The fastener may be any threaded device, and it may be spring loaded. The fastener may be a female threaded device and the elongated port engagement member a male threaded device, wherein the female fastener may be threaded on to the male elongated port engagement member. More than one fastener may be used, and the fasteners may contact the inner or outer perimeter of the ports.

Reference will now be made in detail to the accompanying drawings, which at least assist in illustrating various pertinent embodiments of the new technology provided for by the present disclosure.

Figure 2:
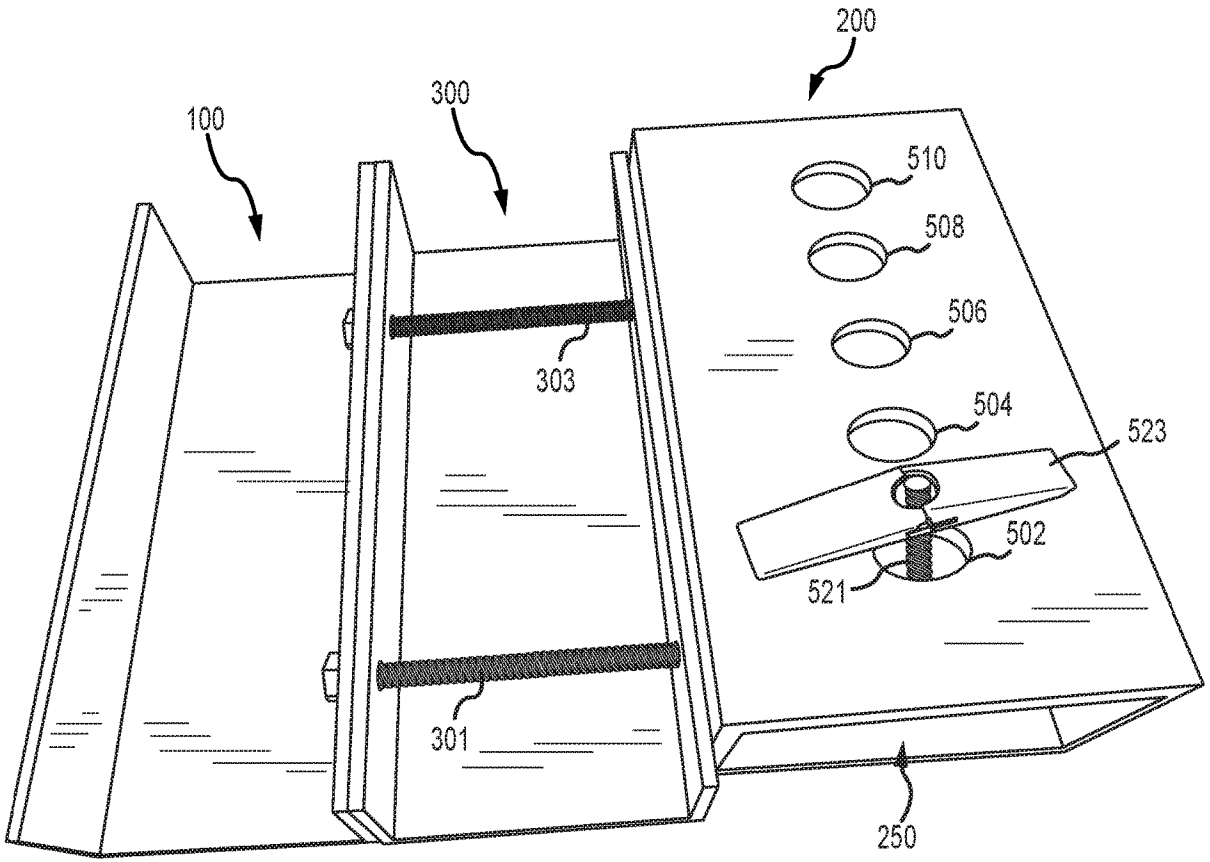
FIG. 2 is a bottom perspective view of one embodiment of a door security apparatus.

FIG. 1 and FIG. 2 illustrate one embodiment of a door security apparatus (1) comprising a door engagement member (100), a spacer (300) and a sleeve member (200). The door engagement member (100) is an apparatus (100) having a channel (110) configured to engage a top of a door (e.g. the top edge of a door, and which is not pictured). The door engagement member comprises a first side (101) with a top edge (102) and a bottom edge (103), a second side (104) with a top edge (105) and a bottom edge (106), and a top side (107) interconnecting the first side (101) and second side (104), defining the channel (110). The channel (110) may be configured to fit any shape of the top of a door, and the top side (110) of the door engagement (100) member may further be configured or customized to allow the door to close properly.

Referring again to FIG. 1 and FIG. 2, the door engagement member (100) has a channel (110) that is configured to slidably engage the top of the door. The channel (110) and sleeve member (200) may be configured at any angle relative to one another so that the channel (110) may engage with the top edge of a door in a manner which is sufficient to allow the sleeve member (200) to engage with the double-lever arms (402, 403) of a door closer (400), whether the door closer body (401) is attached to the door or the frame of the door.

The sleeve member (200), as also seen in FIG. 1 and FIG. 2, is an apparatus (200) comprising a hollow, tubular channel (250), further comprising a locking system (500) and a retaining device (520) as further described in detail below. The tubular channel (250) is rectangular in shape. The tubular channel (250) is configured to slide over double-lever arms (402, 403) of the door closer (400). The sleeve member further comprises a locking system (500). The locking system (500) comprises a plurality of top ports (501, 503, 505, 507, 509) and bottom ports (502, 504, 506, 508, 510) disposed in the sleeve member (200). In one embodiment, the spacer (300) is removably attached to the door engagement member (100) and the sleeve member by one or more bolts (301, 303).

As seen in FIG. 1 and FIG. 2, the retaining device (520) is configured to engage at least one port (501) of the locking system (500) and further comprises an elongated port engagement member (521) and a fastener (522). The elongated port engagement member (521) may be a pin, rod, screw or any elongated device that may be disposed through at least one port of the locking system. A fastener (522) is attached to the elongated port engagement member (521), wherein the fastener (521) is configured to keep the elongated port engagement member (522) engaged with the port (501). The fastener may be a first fastener (522) and the retaining device (520) may further comprise a second fastener (523). The first fastener (522) is further configured to physically engage with a perimeter of the first port (501). The second fastener (523) is further configured to physically engage with the perimeter of the second port (502). The fastener (522) may be a female threaded device, and the elongated port engagement member (521) may be a male threaded device, wherein the fastener (522) is threaded onto the port engagement member (521) in order to keep the port engagement member (521) within the port (501). The port engagement member (521) may be disposed through any of the ports, and may further be disposed through a first port (501) and a second port (502) as disclosed in FIG. 1 and FIG. 2.

Referring to FIG. 1, the spacer (300) is an apparatus (300) having a first edge (302) and a second edge (304), wherein the first edge (302) connects with a door engagement member (100), and wherein the second edge (304) connects with the sleeve member (200). The spacer is connected to the door engagement member (100) and the sleeve member (200) by two bolts (301 and 303).

Figure 3:
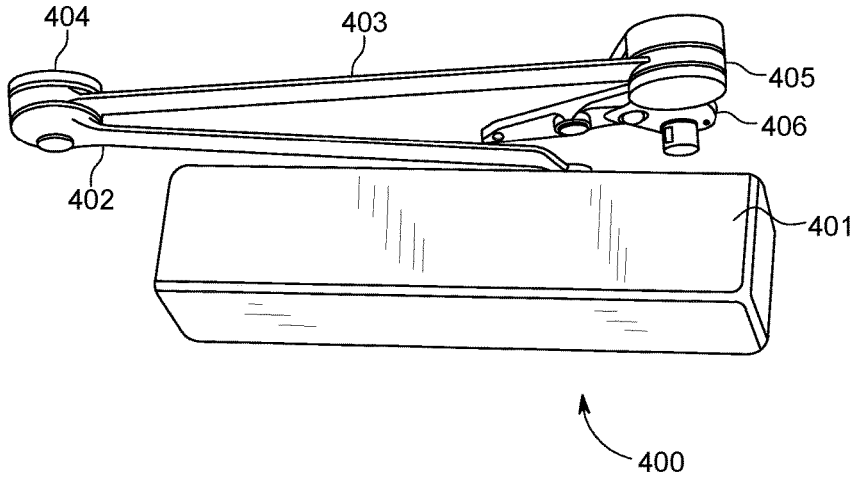
FIG. 3 is a perspective view of one embodiment of a typical double-lever arm door closer.

One example of a typical double-lever arm door closer is embodied in FIG. 3, which shows an apparatus (400) with a door closer body (401) connected to a first double-lever arm (402), which is connected to a second double-lever arm (403) via a first joint (404), wherein the second double-lever arm (403) further comprises a second joint (405) connecting the second double-lever arm (403) to an attachment apparatus (406) that is configured to attach the second double-lever arm (403) to a door or frame of a door. In some embodiments, the door closer body (401) may be connected to a door and the second double-lever arm (403) may be directly connected to the frame of the door. In other embodiments, the door closer body (401) may be connected to a frame of a door, and the second double-lever arm (403) may be directly connected to the door. In some embodiments, the second double-lever arm (403) may be attached to an attachment apparatus (406) by a second joint (405), whereby the attachment apparatus (406) is configured to attach the second double-lever arm (403) to a door or a frame of a door.

Figure 4:
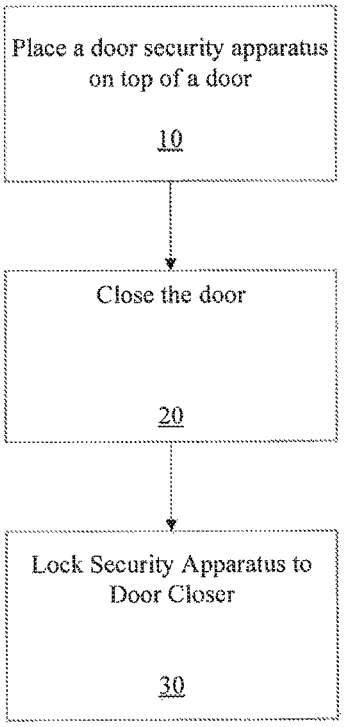
FIG. 4 is flow diagram of one embodiment of a method for using a door security apparatus.
Figure 5:
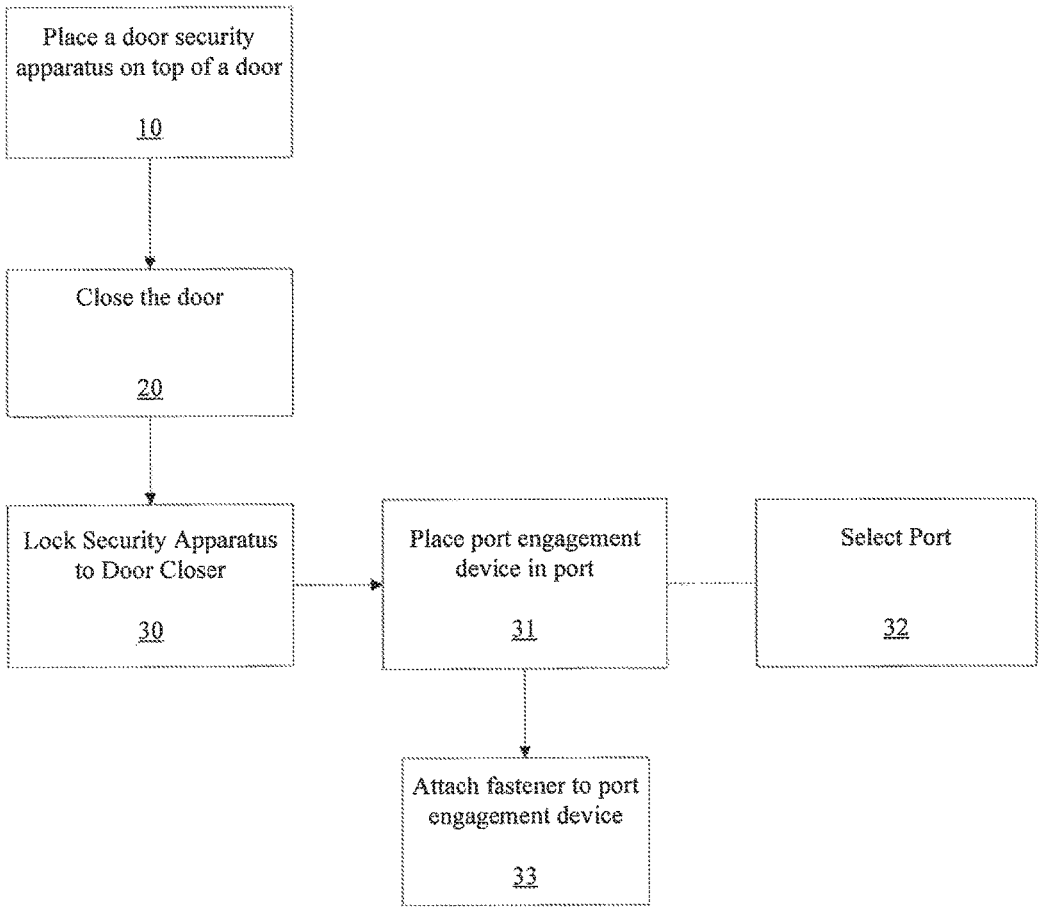
FIG. 5 is a detailed flow diagram of the method of FIG. 4.
Figure 6A:
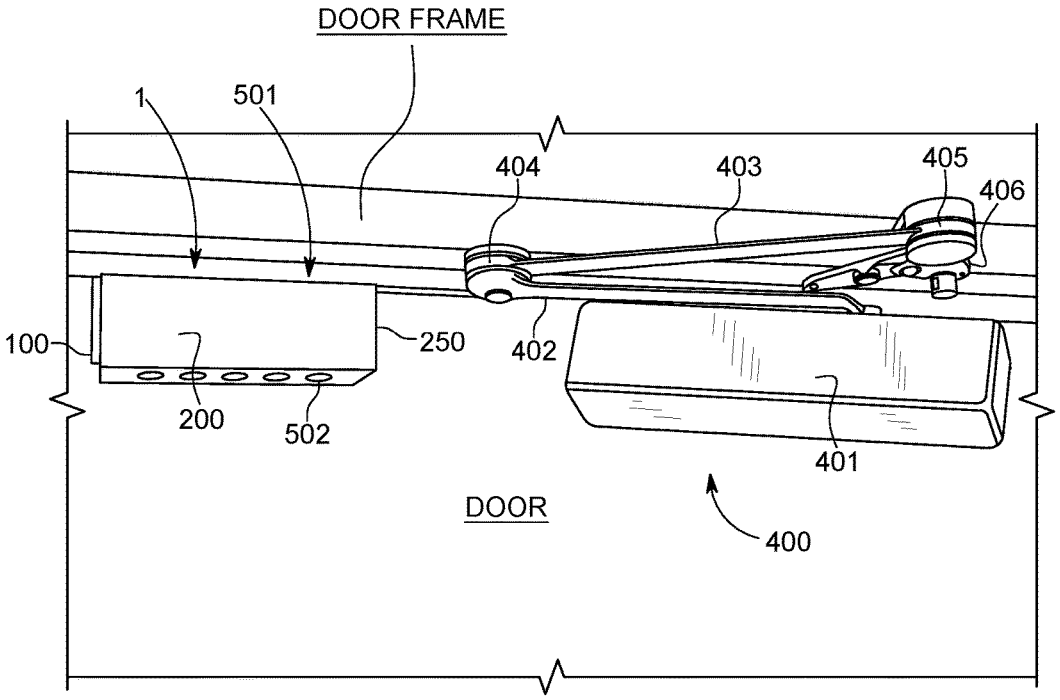
FIG. 6A is a perspective view of the door security apparatus shown in FIGS. 1 and 2 after performing the placing step and the closing step shown in FIG. 4.
Figure 6B:
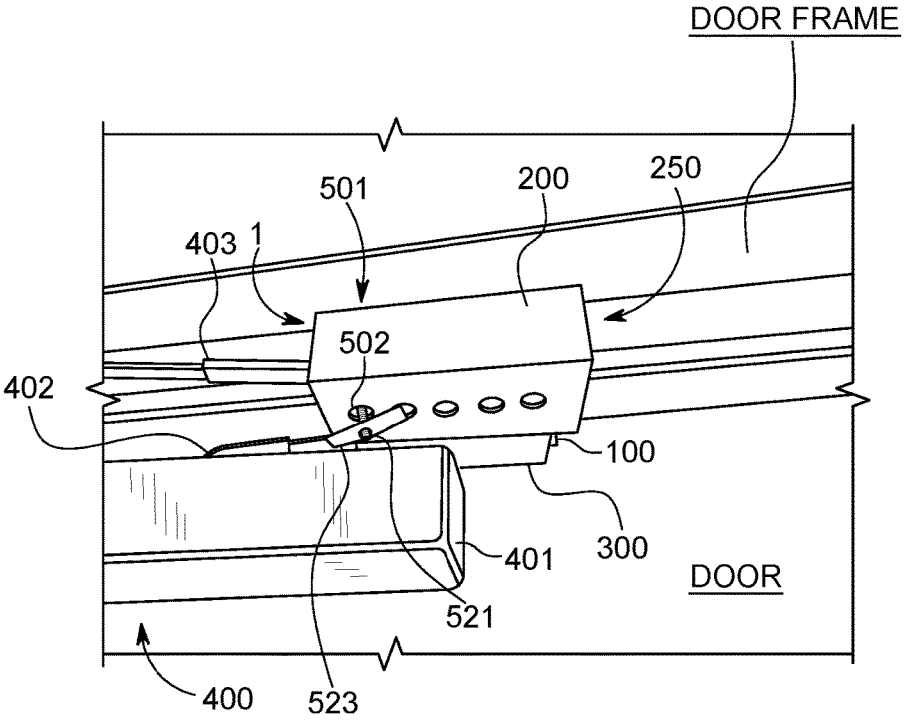
FIG. 6B is a perspective view of the door security apparatus shown in FIGS. 1 and 2 after performing the locking step shown in FIG. 4.

Referring to FIG. 4, disclosed is one example of a method of using the door security apparatus embodied in FIG. 1 and FIG. 2. The method comprises the steps of (10) placing the door security apparatus on top of a door, (20) closing the door, and (30) locking the door security apparatus to the door closer. The door security apparatus may be placed on the door at any time, including at the time of need, or far in advance of the time of need. As seen in FIG. 5, the locking step (30) further comprises disposing a port engagement member into a port (32), and attaching a fastener to the port engagement member (33). In some embodiments, the disposing step further includes a selecting step (33) for selecting at least one port for the disposing step (32). The door may be any door that people walk through, but is preferably a door where a portable and temporary security apparatus would be beneficial, whether used alone or in combination with a pre-existing locking mechanism or security device. The door may be, for example, a door to a hotel or motel, an office, an apartment, a movie theater, a bathroom, or a classroom. FIG. 6A illustrates the door security apparatus (1) embodiment shown in FIGS. 1 and 2 after performing the placing step (10) and the closing step (20). FIG. 6B illustrates the door security apparatus (1) embodiment shown in FIGS. 1 and 2 after performing the locking step (30).

Figure 7:
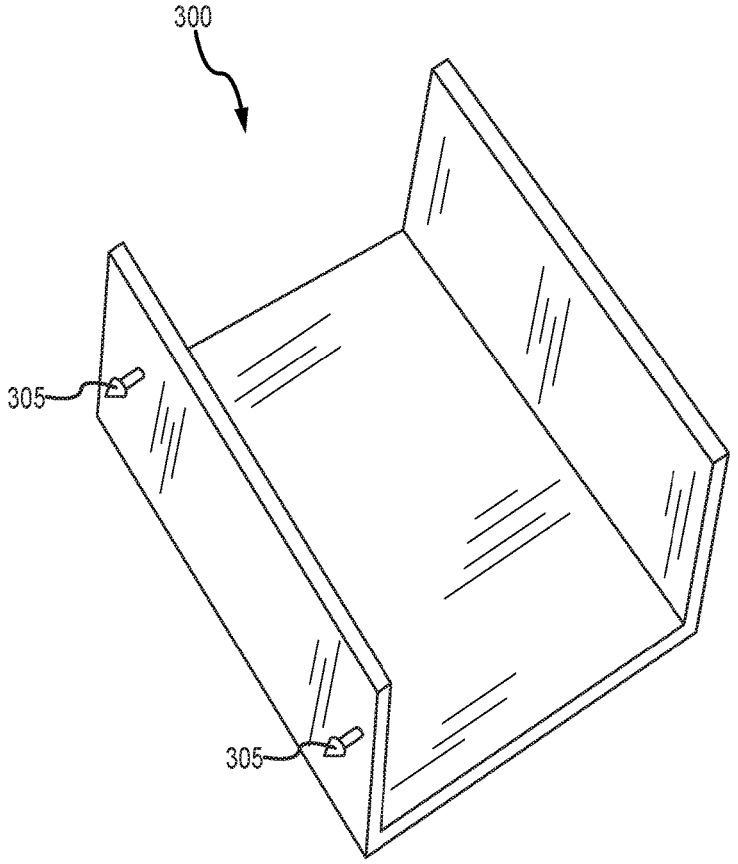
FIG. 7 is a perspective view of one embodiment of a door security apparatus wherein the spacer is attached to the door engagement member or sleeve by a click-lock mechanism.
Figure 8:
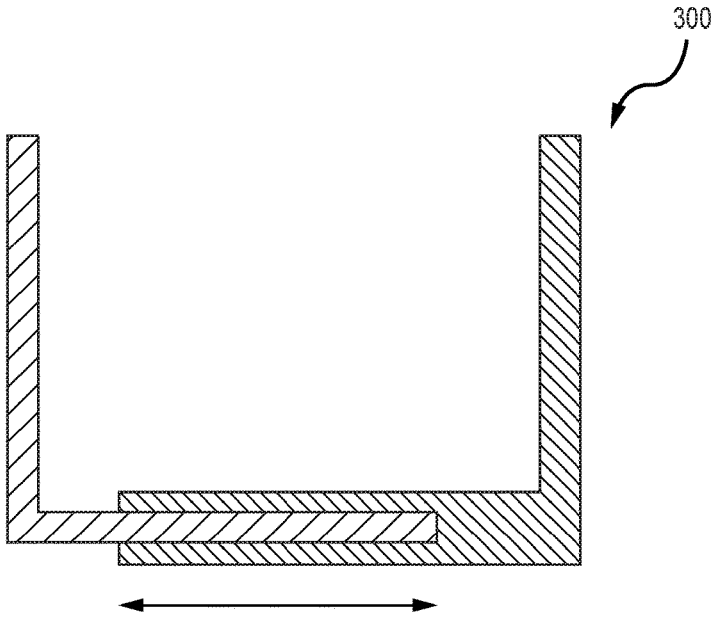
FIG. 8 is a side perspective view of one embodiment of the spacer wherein the spacer has an adjustable width.
Figure 9:
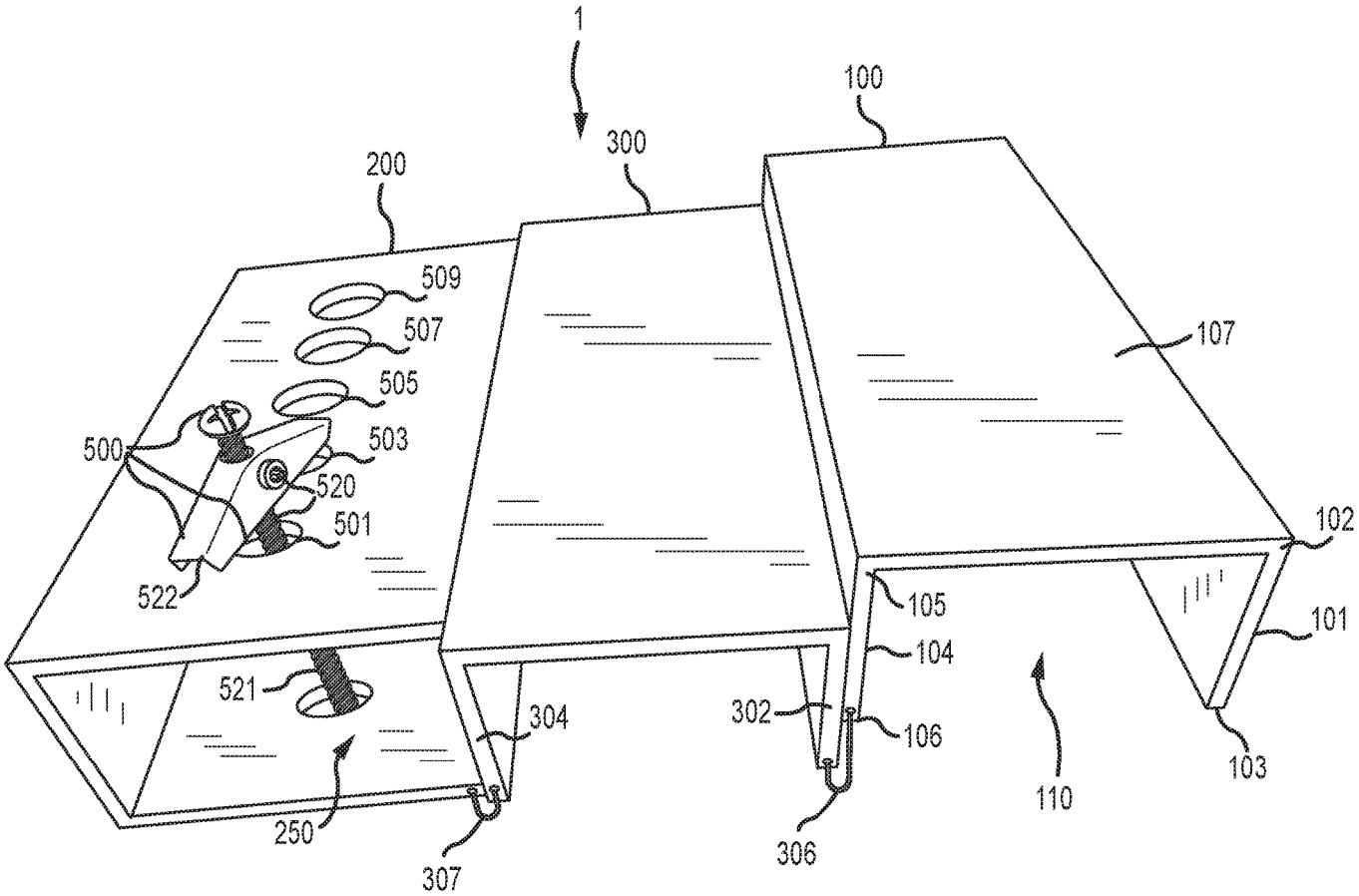
FIG. 9 is a perspective view of one embodiment of a door security apparatus wherein the spacer comprises a link.

Referring now to FIG. 7, illustrated is one embodiment of the spacer (300) wherein the spacer may be connected to either the door engagement member or the sleeve member by a click-lock mechanism (305). In one embodiment, the spacer may have an adjustable length, width or height. As an example, FIG. 8 illustrates a spacer (300) with an adjustable width. In some embodiments, the spacer may comprise a link or a tether wherein the link or the tether comprises a non-planar device, and wherein the non-planar device comprises at least one of a chain, a wire, a spring, a cord and a rope. As an example, FIG. 9 illustrates a spacer comprising a link wherein the link is a cord (306, 307).

In some embodiments, the locking step (30) comprises restricting the double-lever arms of the double-lever arm door closer from moving to an open position. In some embodiments the disposing step (32) further comprises restricting the sleeve member from disengaging the double-lever arm door closer. In some embodiments, the attaching step (33) further comprises preventing the elongated port engagement member from disengaging with the port.

In some embodiments of the method, the at least one port is a first port and the locking system further comprises a second port adjacent to the first port, wherein the selecting step (33) comprises selecting either the first port or the second port for the disposing step (32); and then completing the disposing step (32). There may be multiple ports, and selecting step (33) is to select the port that will best lock the sleeve member onto the double-lever arms of the door closer. In some embodiments, the at least one port is a first (top) port and the locking system further comprises a second (bottom) port, wherein the disposing step (32) further comprises disposing the elongated port engagement member through the first (top) port and the second (bottom) port.

In some embodiments of the method the fastener is a first fastener and the retaining device further comprises a second fastener, wherein the attaching step (33) further comprises attaching the first fastener to the elongated port engagement member at a perimeter of the first port, and attaching the second fastener to the elongated port engagement member at a perimeter of the second port.

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. A door security apparatus for placing on a top of a door, the door including a double-lever arm door closer having double-lever arms, said apparatus comprising:

(a) a door engagement member having:
  i. a first side with a top edge and a bottom edge;
  ii. a second side with a top edge and a bottom edge;
  iii. a top side interconnecting the first side and the second side, thereby defining a channel that receives the top of the door;

(b) a sleeve member, wherein the sleeve member comprises a hollow, tubular channel that slidably engages the double-lever arm door closer when the double-lever arm door closer is in a closed position and thereby restricts the double-lever arms of the double-lever arm door closer from moving from a closed position to an open position; and (c) a spacer, wherein the spacer is connected to the door engagement member and to the sleeve member.

2. The apparatus of claim 1, wherein the sleeve member further comprises a locking system wherein the locking system comprises:

i. a port disposed within the sleeve member; and ii. a retaining device configured to engage the port, wherein the retaining device comprises:
  A. an elongated port engagement member disposed through the port, wherein, as disposed, the elongated port engagement member restricts the sleeve member from disengaging from the double-lever arms; and
  B. a fastener attached to the elongated port engagement member, wherein, as attached, the fastener is configured to physically engage a perimeter of the port.

3. The apparatus of claim 2, wherein the port is a first port and the locking system further comprises a second port disposed within the sleeve member, wherein the elongated port engagement member is disposed through both the first port and the second port.

4. The apparatus of claim 3, wherein the fastener is a first fastener and the retaining device further comprises a second fastener, wherein the first fastener is configured to engage the perimeter of the first port, and wherein the second fastener is configured to engage a perimeter of the second port.

5. The apparatus of claim 2, wherein the port is a first port and the locking system further comprises a second port adjacent to the first port, wherein the elongated port engagement member is disposed through either the first port or the second port.

6. The apparatus of claim 2, wherein the elongated port engagement member is a threaded male member and the fastener is a threaded female member, wherein the fastener is threaded onto the elongated port engagement member.

7. The apparatus of claim 2, wherein the fastener is spring-loaded to engage the perimeter of the port.

8. The apparatus of claim 1, wherein the spacer comprises a first edge and a second edge, and wherein the first edge connects with the door engagement member, and wherein the second edge connects with the sleeve member.

9. The apparatus of claim 8, wherein the spacer is permanently attached to at least one of the door engagement member and the sleeve member.

10. The apparatus of claim 8, wherein the spacer is removably attached to at least one of the door engagement member and the sleeve member.

11. The apparatus of claim 8, wherein the spacer is attached to at least one of the door engagement member and the sleeve member by one or more bolts.

12. The apparatus of claim 8, wherein the spacer is attached to at least one of the door engagement member and the sleeve member by at least one of welding and soldering.

13. The apparatus of claim 8, wherein the spacer is attached to at least one of the door engagement member and the sleeve member by a click-lock mechanism.

14. The apparatus of claim 8, wherein at least one of a width, a length, and a thickness of the spacer is adjustable.

15. The apparatus of claim 1, wherein the spacer extends between the door engagement member and the sleeve member.

16. The apparatus of claim 1, wherein the spacer comprises a link or a tether, wherein the link or the tether comprises a non-planar device, and wherein the non-planar device comprises at least one of a chain, a wire, a spring, a cord, and a rope.

17. A method comprising:

(a) placing a door security apparatus on top of a door, wherein the door includes a double-lever arm door closer having double-lever arms, and wherein the door security apparatus comprises:

i. a door engagement member having:

A. a first side with a top edge and a bottom edge;

B. a second side with a top edge and a bottom edge;

C. a top side interconnecting the first side and the second side, thereby defining a channel for receiving the top of the door;

ii. a sleeve member, wherein the sleeve member comprises:

A. a hollow, tubular channel; and

B. a locking system, wherein the locking system comprises:

(I) at least one port disposed within the sleeve member; and (II) a retaining device comprising an elongated port engagement member and a fastener; and iii. a spacer connected to the door engagement member and to the sleeve member;

(b) closing the door;

(c) after the closing step, sliding the hollow, tubular channel of the sleeve member over the double-lever arms of the double-lever arm door closer, thereby restricting the double-lever arms of the double-lever arm door closer from moving from a closed position to an open position;

(d) after the sliding step, disposing the elongated port engagement member into the at least one port of the locking system, thereby restricting the sleeve member from disengaging the double-lever arm door closer; and (e) after the disposing step, attaching the fastener to the elongated port engagement member, thereby preventing the elongated port engagement member from disengaging with the port.

18. The method of claim 17, wherein the at least one port is a first port and the locking system further comprises a second port adjacent to the first port, wherein the disposing step (d) further comprises selecting either the first port or the second port for the disposing step (d); and then completing the disposing step.

19. The method of claim 17, wherein the at least one port is a top port and the locking system further comprises a second port, wherein the second port is a bottom port, and wherein the disposing step (d) further comprises disposing the elongated port engagement member through the top port and the bottom port.

20. The method of claim 19, wherein the fastener is a first fastener and the retaining device further comprises a second fastener, wherein the attaching step (e) further comprises attaching the first fastener to the elongated port engagement member at a perimeter of the top port, and attaching the second fastener to the elongated port engagement member at a perimeter of the bottom port.

* * * * *